US005718456A

United States Patent [19]

Detwiler, II et al.

[11] Patent Number: 5,718,456

[45] Date of Patent: Feb. 17, 1998

[54] METHOD FOR VERIFYING AUTHENTICITY OF SALES RECORD

[75] Inventors: Michael F. Detwiler, II, Golden; Bryan Hodges, Denver, both of Colo.

[73] Assignee: Michael F. Detwiler, Jr., Golden, Colo.

[21] Appl. No.: 654,010

[22] Filed: May 28, 1996

Related U.S. Application Data

[63] Continuation of Ser. No. 188,379, Jan. 26, 1994, abandoned.

[51] Int. Cl.[6] ..... B42D 15/00

[52] U.S. Cl. ..... 283/67; 283/114

[58] Field of Search ..... 283/67, 92, 114, 283/95

[56] References Cited

U.S. PATENT DOCUMENTS

| | | | |
|---|---|---|---|
| 3,995,741 | 12/1976 | Henderson | 283/114 X |
| 4,227,719 | 10/1980 | McElligott et al. | 283/58 X |
| 4,629,630 | 12/1986 | Devrient | 283/58 X |
| 4,725,497 | 2/1988 | Honnorat et al. | 283/114 X |
| 4,773,778 | 9/1988 | Pietsch et al. | 400/241.1 |
| 4,884,828 | 12/1989 | Burnham et al. | 283/89 |
| 4,931,348 | 6/1990 | Kleuh et al. | 428/207 |
| 5,058,925 | 10/1991 | Dotson | 283/95 |
| 5,062,725 | 11/1991 | Hogarth et al. | 400/195 |
| 5,120,088 | 6/1992 | Radcliffe et al. | 283/67 |
| 5,124,217 | 6/1992 | Gruber et al. | 430/39 |
| 5,261,954 | 11/1993 | Collings | 283/114 X |
| 5,279,222 | 1/1994 | Di Luco | 283/114 X |
| 5,368,334 | 11/1994 | Christy et al. | 283/114 X |

FOREIGN PATENT DOCUMENTS

| | | | |
|---|---|---|---|
| 2365656 | 5/1978 | France | 283/114 |
| 2399505 | 4/1979 | France | 283/114 |
| 2406027 | 6/1979 | France | 283/114 |
| 2410702 | 8/1979 | France | 283/114 |

*Primary Examiner*—Frances Han

*Attorney, Agent, or Firm*—Douglas F. Vincent

[57] ABSTRACT

A method for verifying the authenticity of a sales record, including the steps of: 1) providing a printer ribbon with an ink applied thereto, said ink having a first color and being capable of changing to a second color when acted upon by a reagent; 2) utilizing said printer ribbon to print sales records at the point of sale; and 3) verifying the authenticity of said sales records by exposing said sales records to a reagent capable of causing said ink to change to a second color identifiably distinct from said first color to identify as unauthentic any printing on said sales record not accomplished by said ink. Optionally, the ink used may be oil-based.

4 Claims, No Drawings

METHOD FOR VERIFYING AUTHENTICITY OF SALES RECORD

This is a continuation of application Ser. No. 08/188,379, filed on Jan. 26, 1994, now abandoned.

TECHNICAL FIELD

This invention relates to a method for preventing sales record fraud, and more particularly to a method for verifying the authenticity of sales records by printing the records with an ink capable of changing color when acted upon by a secondary reagent.

BACKGROUND ART

Retail stores face a tremendous amount of sales receipt fraud, losing many millions of dollars each year. In response, many retailers have created entire loss prevention departments that specialize in securing the retailer's assets from fraudulent loss. This type of fraud has increased dramatically over the past few years due to the relatively inexpensive availability of home computers, digital scanners, dot matrix printers, micromechanism printers, color laser printers and color copiers. Those mechanisms allow for the easy reproduction of sales receipts, sales records and other documents.

Sales receipt fraud may take many forms, such as claiming possession of items from a retailer's distribution warehouse that requires a proof of purchase (some type of sales receipt or sales record from a separate location), or the fraudulent duplicating of a sales receipt or sales record to return stolen goods for cash or other goods of equal value.

The standard method of certifying payment for goods purchased is issuance of some form of paper sales record, usually a sales receipt. This method is advantageous to both the retailer and to the consumer because of its low cost and relative ease of documentation in the case of return of goods. The printed paper receipt serves as a document which certifies that the bearer has purchased the goods listed on the receipt. The individual can then receive the listed goods, exchange them, or return them for cash and/or goods of equal value. In the past, duplicating or counterfeiting of sales receipts was difficult unless one had access to a dot matrix printer or similar printing device that simulated cash-register-type printing, as well as access to ink ribbon and paper rolls similar to those used by the retailer. Today, with the opening of office supply "super-stores" and new inexpensive computer, duplication, and printing equipment, sales receipt fraud is becoming relatively easy to accomplish. This creates a great need for an inexpensive process to verify the authenticity of sales receipts and similar documents. In fact, the seriousness of the sales receipt fraud problem has been escalating rapidly in recent years as the technology needed for such fraud has become cheaper and more effective.

Various methods have been used to deter the counterfeiting of sales records. The ideal solution would be cost effective and easily manageable for the retailer, while not being inconvenient for the consumer. One approach which can make the practice of counterfeiting more difficult is the use of specially printed paper. Such an approach is disclosed in U.S. Pat. No. 4,037,007 to Wood. Wood discloses a special paper having aggregates of color formers, called "planchettes," incorporated therein. When a reagent is applied to the paper, the planchettes react with the reagent to cause an identifiable color change useful for authentication of a document printed on the paper. These paper products could be used to produce receipt to rolls. When confronted by this method, an individual bent on receipt fraud has to duplicate or obtain the paper roll used by the retailer in order to duplicate the receipt accurately. Ensuring that these special paper rolls are not obtained by counterfeiters is difficult. They can be purchased from employees or stolen from various sources, and once obtained can be used to generate a great number of fraudulent receipts. The method of using special paper can also generate a false sense of security, since anything printed on the retailer's paper, even if it is printed slightly inaccurately or irregularly, will likely be accepted. This method has the added drawback that the paper is typically expensive, which can be important when large volumes of the paper must be used.

U.S. Pat. No. 4,957,312, to Morello illustrates the case of a split-character print ribbon to prevent receipt fraud. The ribbon of Morello is divided into two, or sometimes three, different color strips extending along the length of the ribbon. When used to print sales receipts, this ribbon produces a two-color print that is more difficult to duplicate.

One problem with the Morello approach is that modern P.C.'s, scanning devices, and color printers allow for easy duplication of any color. Another problem with this approach is that two-color ribbons must use nonmigrating inks that keep the inks from mixing on the ribbon. This reduces the ribbon's life since the ribbon lasts only as long as both colors are present. There is also poorer capillary flow of the ink, due to the nonmigrating medium, on the substrate reducing the redispersal of the ink. Ribbons of this nature typically have 20% to 60% of the life that a single color ribbon possesses.

A further problem with the approach of Morello is that two-color ribbons are presently available at office supply stores, allowing easy access to the security product. Finally, two-colored receipts are sometimes viewed as offensive by retailers and consumers, who find them a constant reminder of security problems.

Another approach to the sales receipt fraud problem is illustrated by U.S. Pat. No. 5,209,513, to Batelli, which uses fluorescent ink to produce special anticounterfeiting paper rolls and ribbons. A drawback to this approach is that this security method requires the retailer to buy expensive U.V. illuminating equipment. The illuminating equipment is typically too large and costly to be kept at every register so retailers build a central return and exchange counter. This method can make the process of returns and exchanges slow and inefficient during peak business periods. This is very important in a competitive market where customer happiness and loyalty are paramount. Furthermore, it also requires specialized personnel and causes a loss of retail space, each with a corresponding increase in cost. Also, there remains the problem of keeping the paper rolls with the special ink out of the hands of the counterfeiters. The rolls can be dug out of the trash, stolen, or bought from employees of the store. Once obtained they can be used to produce many fraudulent receipts. Maintaining the security of the ribbon is easier than that of the paper rolls. The ribbon cartridge is a necessary component in the function of the register, whereas a large section of the paper roll could be removed without any trace and the register would still function properly.

DISCLOSURE OF THE INVENTION

In accordance with the present invention, there is provided a method for verifying the authenticity of a sales record, comprising the steps of: (1) providing a printer ribbon with an ink applied thereto, said ink having a first color and being capable of changing to a second color when acted upon by a reagent; (2) utilizing said printer ribbon to print sales records; and (3) verifying the authenticity of said sales records by exposing said sales records to a reagent capable of causing said ink to change to a second color identifiably distinct from said first color.

Optionally, the method for verifying the authenticity of a sales record, may comprise the steps of: (1) providing means for printing an ink onto a sales record, said ink having a first and second coloring agent causing the ink to have an original color, said first coloring agent being color-sensitive to a reagent having a basic pH; (2) printing said sales record by printing said ink onto a print medium; and (3) verifying the authenticity of said sales record by applying thereto a basic reagent having a pH basic enough to cause said first coloring agent to change color, causing the print on said sales record to change from said original color to a second, visibly distinct color.

Based on the foregoing, several advantages of the present invention may be seen. The present invention improves upon known approaches discussed earlier, by using a single-color matrix type ink that not only allows free capillary flow but also can be applied to the full width of the ribbon. Previous methods required the use of "Bi-chrome" inks, that by their nature must inhibit capillary flow in order to maintain color separation. In addition, one color of the bi-chrome inks must be applied to a portion of the ribbon width while the other ink color must be applied to the other portion of the width. Since this requires printing on the line separating the two colors, the life of the ribbon is limited to the life of, at most, half the width of the ribbon. The present invention improves the potential life or character yield of the ribbon greatly, which is very cost effective. Also, the application of bi-chrome ink in a multi-color is a much more costly inking process which has to be passed on to the retail customer. The present invention, by using a single-color matrix ink (containing the color changing agents) that involves a low-cost inking process, provides the retailer a low cost per character overall making the present invention a more cost effective way of reducing losses arising from counterfeiting of sales receipts and/or records.

The method of the present invention reduces losses that would otherwise arise from the fraudulent use of counterfeit sales receipts, records or other documents by accurately identifying such fraudulent documents. The present invention serves to identify those parties who attempt to defraud the retailer or other parties through the use of counterfeit sales receipts, sales records or other documents. This process can be incorporated into the current loss prevention activities of the retailers without large capital expenditures.

The present invention has the further advantage of being difficult for the counterfeiter to duplicate. Even if a ribbon of the present invention were to be stolen, it would be difficult to utilize without the cash register for which it was designed. Such cash registers are very expensive and difficult to purchase. Each register also has specific print fonts and print graphics built into it by the manufacturer and the retailer. These are relatively easy to copy, but would be difficult to reproduce using a stolen ribbon.

This present invention also improves the prior art when the present invention's ink is incorporated with the multi-colored sales receipt or record. This assures that if the receipt record, sales record or other document is duplicated with the same color split, even if it employs the prior art of the split character printing, there will still be a color change to assure the authenticity of the sales receipt, sales record or other document. Methods which use only a visual deterrent, do not require more action from the retailer other than simply examining the receipt. The present invention improves on this by requiring that the retailer take an active role through the introduction of a secondary outside agent and verifying the color change in the print in order to ensure the authenticity of the sales receipt, sales record or other document.

The present invention also offers the retailer a ribbon that will produce similar character yields as a non-security type ribbon. Conventional methods when incorporated into a ribbon, because of the inking techniques and the nature of the ink that is used (non-migrating inks, as discussed), will not yield as many alphanumeric characters as a single-colored ribbon. Capillary flow and the viscosity of the ink's medium determine the re-inking characteristics of a particular ribbon. Since the split-color ribbon uses non-migrating inks (high viscosity and little capillary flow on the substrate) to keep the two inks separate, the typical reinking process of the ribbon is limited. The present invention, because it uses a single-colored ink and a lower viscosity (migrating) oil medium, produces approximately the same number of alphanumeric characters as a non-security type of ribbon.

The present invention may also use a low-cost felt marker to apply the secondary outside agent to verify authenticity of the sales receipt or record. This provides an efficient and cost-effective verification method which can also be kept at every register or return counter. This makes the security feature quite flexible and convenient.

Finally, using varying dyes and pigments in the present invention would also require an extensive knowledge of chemical compounds and their use with regard to oil-based inks to reproduce the specific color change reaction. A potential solution, especially if the retailer already has the U.V. equipment in place, is to incorporate the present invention into U.V. programs. U.V. inks can be readily incorporated into the oil-based medium of the present invention.

Additional advantages of this invention will become apparent from the description which follows.

BEST MODE FOR CARRYING OUT THE INVENTION

In accordance with the present invention, there is provided a method for preventing sales record fraud, including a first step of providing a printer ribbon with a color-changing ink applied thereto. The printer ribbon may be of any commonly used transfer medium such as nylon, cotton, silk, porous rubber, or other suitable medium. The ink originally has a first color suitable for printing a sales record, such as a sales receipt, purchase record, or other printed record of a transaction. The ribbon is then used in the usual manner such as in a cash register to print a sales receipt.

Once printed, the sales receipt or other record is given to the customer as proof of the transaction. The benefits of the present invention occur if and when the customer should seek to present the sales record for a refund or exchange with respect to his purchased item(s). At that point, the sales record may be verified by applying a secondary reagent which causes the ink to change to a second color. The choice of inks and reagents is made so that the color change from the first to the second color is readily visible with the naked eye. Application of the reagent may conveniently be effected by use of a felt marker containing a solution having the reagent therein.

This method is adaptable to printing methods other than those using ribbons, as for example where the ink is to be applied onto the sales record using a bubble jet printer or the like. Ink suitable for use with a bubble jet printer would necessarily be water-based to avoid clogging the mechanism. By contrast, an ink would necessarily be oil-based in order to be used on a ribbon, because a water-based ink would cause corrosion of the print head mechanism, and have evaporation problems, if used on a ribbon. Numerous combinations of inks, reagents, and type of reaction are feasible for accomplishing the color change of the present invention. The preferred types of reactions for causing the color change include changes of pH to more acidic or basic, and oxidation or reduction reactions.

Generally, the ink will contain two coloring agents, either dyes or pigments, the first one of which will lose its color when acted upon by a reagent, allowing the second to change or form color and dominate the ink color, causing a significant and identifiable color change. An equally effective alternative is to have the first dye or pigment maintain a constant color when subjected to the reagent, while the second coloring agent changes color or has its color intensified by the reagent, causing the color of the printed ink to change. Examples of suitable ink compositions, reagents, and reactions are presented below.

EXAMPLE 1

INK:

| | |
|---|---|
| Castor oil | 31.5% |
| Vegetable oil | 9.3% |
| Anti-oxidant | .2% |
| Chemester 20/50 An Ester used for drying and viscosity control | 16.0% |
| Methyl oleate Consisting of: 35% Oleic acid 30% Methyl violet 35% solvent yellow | 30.0% |
| | 100.0% |

ORIGINAL INK COLOR: Purple
REAGENT: Hydrochloric acid or Sulfuric acid in solution with water with pH≧2
REACTION: pH of ink is lowered Methyl violet die becomes colorless Solvent yellow #4 becomes red
SECOND INK COLOR: Red

EXAMPLE 2

INK:

| | |
|---|---|
| Castor oil | 40.5% |
| Vegetable oil | 8.3% |
| Anti-oxidant | .2% |
| Chemester 20/50 | 16.0% |
| Methyl oleate Consisting of: 40% Oleic acid 35% Malachite green carbonol base 25% phenolphthalein | 35.0% |
| | 100.0% |

ORIGINAL INK COLOR: Green
REAGENT: Solution of Sodium hydroxide or other base with pH≦9
REACTION: pH raised phenolphthalein turns bright red Green is unchanged Red predominates
SECOND INK COLOR: Red In examples 1 and 2, the dye proportions and the reagent pH's are the important factors to be considered. The oil base is used simply as a vehicle for carrying the dyes, and will be adjusted, primarily for viscosity, to best suit the particular ribbon and equipment being utilized.

This invention has been described in detail with reference to a particular embodiment thereof, but it will be understood that various other modifications can be effected within the spirit and scope of this invention.

We claim:

1. A method for verifying the authenticity of a sales record, comprising the steps of:

(1) providing a printer ribbon with an ink applied thereto, said ink having a first color and being capable of changing to a second color when acted upon by a reagent;

(2) utilizing said printer ribbon to print legible sales records at the point of sale; and (3) verifying the authenticity of said sales records by exposing said sales records to a reagent capable of causing said ink to permanently change to a second color identifiably distinct from said first color when viewed with the naked eye, to identify as unauthentic any printing on said sales record not accomplished by said ink.

2. A method for verifying the authenticity of a sales record, comprising the steps of:

(1) providing means for printing an ink onto a sales record, said ink having a first and second coloring agent causing the ink to have an original color, said first coloring agent being color-sensitive to a reagent having a basic pH;

(2) printing a legible sales record by printing said ink onto a print medium at the point of sale; and (3) verifying the authenticity of said sales record by applying thereto a basic reagent having a pH basic enough to cause said first coloring agent to change color, causing the print on said sales record to permanently change from said original color to a second color, visibly distinct when viewed with the naked eye from said first color, to identify as unauthentic any printing on said sales record not accomplished by said ink.

3. A method for verifying the authenticity of a sales record, comprising the steps of:

(1) providing means for printing an ink onto a sales record, said ink having a first and second coloring agent causing the ink to have an original color, said first coloring agent being color-sensitive to a reagent having an acidic pH;

(2) printing a legible sales record by printing said ink onto a print medium at the point of sale; and (3) verifying the authenticity of said sales record by applying thereto an acidic reagent having a pH acidic enough to cause said first coloring agent to change color, causing the print on said sales record to permanently change from said original color to a second color, visibly distinct when viewed with the naked eye from said first color, to identify as unauthentic any printing on said sales record not accomplished by said ink.

4. A method for verifying the authenticity of a sales record as claimed in any of claims 1 through 3, wherein:

said ink is oil-based.

* * * * *